US008620645B2

(12) United States Patent
Bruhn

(10) Patent No.: US 8,620,645 B2
(45) Date of Patent: Dec. 31, 2013

(54) NON-CAUSAL POSTFILTER

(75) Inventor: Stefan Bruhn, Sollentuna (SE)

(73) Assignee: Telefonaktiebolaget L M Ericsson (publ), Stockholm (SE)

( * ) Notice: Subject to any disclaimer, the term of this patent is extended or adjusted under 35 U.S.C. 154(b) by 905 days.

(21) Appl. No.: 12/529,682

(22) PCT Filed: Dec. 14, 2007

(86) PCT No.: PCT/SE2007/051000

§ 371 (c)(1),
(2), (4) Date: Sep. 2, 2009

(87) PCT Pub. No.: WO2008/108702

PCT Pub. Date: Sep. 12, 2008

(65) Prior Publication Data

US 2010/0063805 A1 Mar. 11, 2010

Related U.S. Application Data

(60) Provisional application No. 60/892,667, filed on Mar. 2, 2007.

(51) Int. Cl.
*G10L 21/00* (2013.01)

(52) U.S. Cl.
USPC ..... 704/207; 704/270; 704/230; 704/228; 704/223; 704/221; 704/219; 704/214; 704/211; 704/200.1; 375/285; 375/240.25; 370/516; 370/503; 370/352

(58) Field of Classification Search
USPC ..... 704/211, 230, 270, 228, 223, 221, 219, 704/214, 200.1; 370/516, 503, 352; 375/285, 240.5
See application file for complete search history.

(56) References Cited

U.S. PATENT DOCUMENTS 5,664,055 A * 9/1997 Kroon ..... 704/223
5,717,822 A * 2/1998 Chen ..... 704/219
6,052,660 A * 4/2000 Sano ..... 704/221
6,138,093 A * 10/2000 Ekudden et al. ..... 704/228

(Continued)

FOREIGN PATENT DOCUMENTS

EP 1050040 B1 11/2000
EP 0807307 B1 8/2001

OTHER PUBLICATIONS

Juin-Hwey Chen; Gersho, A., "Adaptive postfiltering for quality enhancement of coded speech," Speech and audio Processing, IEEE Transactions on, vol. 3, No. 1, pp. 59-71, Jan. 1995, ISSN: 1063-6676.

(Continued)

*Primary Examiner* — Michael Colucci

(57) ABSTRACT

A decoder arrangement comprising a receiver input for parameters of frame-based coded signals and a decoder arranged to provide frames of decoded audio signals based on the parameters. The receiver input and/or the decoder is arranged to establish a time difference between the occasion when parameters of a first frame is available at the receiver input and the occasion when a decoded audio signal of the first frame is available at an output of the decoder, which time difference corresponds to at least one frame. A postfilter is connected to the output of the decoder and to the receiver input. The postfilter is arranged to provide a filtering of the frames of decoded audio signals into an output signal in response to parameters of a respective subsequent frame.

20 Claims, 9 Drawing Sheets

(56) References Cited

U.S. PATENT DOCUMENTS

| | | | | |
|---|---|---|---|---|
| 6,389,006 | B1 * | 5/2002 | Bialik | 370/352 |
| 6,539,356 | B1 * | 3/2003 | Matsui et al. | 704/270 |
| 6,625,226 | B1 * | 9/2003 | Gersho et al. | 375/285 |
| 6,687,668 | B2 * | 2/2004 | Kim et al. | 704/223 |
| 6,775,649 | B1 | 8/2004 | DeMartin | |
| 7,272,556 | B1 * | 9/2007 | Aguilar et al. | 704/230 |
| 7,353,168 | B2 * | 4/2008 | Thyssen et al. | 704/220 |
| 7,394,833 | B2 * | 7/2008 | Heikkinen et al. | 370/516 |
| 7,512,535 | B2 * | 3/2009 | Chen et al. | 704/228 |
| 7,987,089 | B2 * | 7/2011 | Krishnan et al. | 704/214 |
| 2001/0008995 | A1 * | 7/2001 | Kim et al. | 704/223 |
| 2002/0143527 | A1 * | 10/2002 | Gao et al. | 704/223 |
| 2003/0043856 | A1 * | 3/2003 | Lakaniemi et al. | 370/503 |
| 2004/0002856 | A1 | 1/2004 | Bhaskar et al. | |
| 2004/0008787 | A1 * | 1/2004 | Pun et al. | 375/240.25 |
| 2004/0156397 | A1 * | 8/2004 | Heikkinen et al. | 370/516 |
| 2005/0091046 | A1 * | 4/2005 | Thyssen et al. | 704/211 |
| 2005/0165603 | A1 * | 7/2005 | Bessette et al. | 704/200.1 |

OTHER PUBLICATIONS

P. Kroon, B. Atal. "Quantization procedures for 4.8 kbps CELP coders",in Proc IEEE ICASSP, pp. 1650-1654. 1987.

V. Ramamoorthy, N.S. Jayant, "Enhancement of ADPCM speech by adaptive postfiltering", AT&T Bell Labs Tech. J., pp. 1465-1475, 1984.

V. Ramamoorthy, N. S. Jayant, R Cox, M. Sondhi, "Enhancement of ADPCM speech coding with backward-adaptive algorithms for postfiltering and noise feed-back", IEEE J. on Selected Areas in Communications, vol. SAC-6, pp. 364-382, 1988.

* cited by examiner

NON-CAUSAL POSTFILTER

This application claims the benefit of U.S. Provisional Application No. 60/892,667, filed Mar. 2, 2007, the disclosure of which is fully incorporated herein by reference.

TECHNICAL FIELD

The present invention relates in general to coding and decoding of audio and/or speech signals, and in particular to reducing coding noise.

BACKGROUND

In general, audio coding, and specifically speech coding, performs a mapping from an analog input audio or speech signal to a digital representation in a coding domain and back to analog output audio or speech signal. The digital representation goes along with the quantization or discretization of values or parameters representing the audio or speech. The quantization or discretization can be regarded as perturbing the true values or parameters with coding noise. The art of audio or speech coding is about doing the encoding such that the effect of the coding noise in the decoded speech at a given bit rate is as small as possible. However, the given bit rate at which the speech is encoded defines a theoretical limit down to which the coding noise can be reduced at the best. The goal is at least to make the coding noise as inaudible as possible.

A suitable view on the coding noise is to assume it to be some additive white or colored noise. There is a class of enhancement methods which after decoding of the audio or speech signal at the decoder modify the coding noise such that it becomes less audible, which hence results in that the audio or speech quality is improved. Such technology is usually called 'postfiltering', which means that the enhanced audio or speech signal is derived in some post processing after the actual decoder. There are many publications on speech enhancement with postfilters. Some of the most fundamental papers are [1]-[4].

The basic working principle of pitch postfilters is to remove at least parts of the coding noise which floods the spectral valleys in between harmonics of voiced speech. This is in general achieved by a weighted superposition of the decoded speech signal with time-shifted versions of it, where the time-shift corresponds to the pitch lag or period of the speech. This results in an attenuation of uncorrelated coding noise in relation to the desired speech signal especially in between the speech harmonics. The described effect can be obtained both with non-recursive and recursive filter structures. In practice non-recursive filter structures are preferred.

Relevant in the context of the invention are pitch or fine-structure postfilters. Their basic working principle is to remove at least parts of the coding noise which floods the spectral valleys in between harmonics of voiced speech. This is in general achieved by a weighted superposition of the decoded speech signal with time-shifted versions of it, where the time-shift corresponds to the pitch lag or period of the speech. Preferably, also time-shifted versions into the future speech signal samples are included. One more recent non-recursive pitch postfilter method is described in [5], in which pitch parameters in the signal coding is reused in the postfiltering of the corresponding signal sample. The non-recursive pitch postfilter method of [5] is also applied in the 3GPP AMR-WB+ audio and speech coding standards 3GPP TS 26.290, "Audio codec processing functions; Extended Adaptive Multi-Rate-Wideband (AMR-WB+) codec; Transcoding functions" and 3GPP VMR-WB [3GPP2 C.S0052-A, "Source-Controlled Variable-Rate Multimode Wideband Speech Codec (VMR-WB), Service Options 62 and 63 for Spread Spectrum Systems". One pitch postfilter method is specified in [6]. This patent describes the use of past and future synthesized speech within one and the same frame.

One problem with pitch postfilters which evaluate future speech signals is that they require access to one future pitch period of the decoded audio or speech signal. Making this future signal available for the postfilter is generally possible by buffering the decoded audio or speech signal. In conversational applications of the audio or speech codec this is, however, undesirable since it increases the algorithmic delay of the codec and hence would affect the communication quality and particularly the inter-activity.

SUMMARY

An object of the present invention is to provide improved audio or speech quality from decoder devices. A further object of the present invention is to provide efficient postfilter arrangements for use with scalable decoder devices, which do not contribute considerably to any additional delay of the audio or speech signal.

The above objects are achieved by devices and methods according to the enclosed patent claims. In general words, according to a first aspect, a decoder arrangement comprises a receiver input for parameters of frame-based coded signals and a decoder connected to the receiver input, arranged to provide frames of decoded audio signals based on the parameters. The receiver input and/or the decoder is arranged to establish a time difference between the occasion when parameters of a first frame is available at the receiver input and the occasion when a decoded audio signal of the first frame is available at an output of the decoder, which time difference corresponds to at least one frame. A postfilter is connected to the output of the decoder and to the receiver input. The postfilter is arranged to provide a filtering of the frames of decoded audio signals into an output signal in response to parameters of a respective subsequent frame. The decoder arrangement also comprises an output for the output signal, connected to the postfilter.

According to a second aspect, a decoding method comprises receiving of parameters of frame-based coded signals and decoding of the parameters into frames of decoded audio signals. The receiving and/or the decoding causes a time difference between the occasion when parameters of a first frame is available after reception and the occasion when a decoded audio signal of the first frame is available after decoding, which time difference corresponds to at least one frame. The frames of decoded audio signals are postfiltered into an output signal in response to parameters of a respective subsequent frame. The method also comprises outputting of the output signal.

One advantage with the present invention is that it is possible to improve the reconstruction signal quality of speech and audio codecs. The improvements are obtained without any penalty in additional delay e.g. if the codec is a scalable speech and audio codec or if it is used in a VoIP application with jitter buffer in the receiving terminal. A particular enhancement is possible during transient sounds as e.g. speech onsets.

BRIEF DESCRIPTION OF THE DRAWINGS

The invention, together with further objects and advantages thereof, may best be understood by making reference to the following description taken together with the accompanying drawings, in which.

DETAILED DESCRIPTION

Throughout the present disclosures, equal or directly corresponding features in different figures and embodiments will be denoted by the same reference numbers.

In order to fully understand the detailed description, some terms may have to be defined more explicitly in order to avoid confusion. In the present disclosure, the term "parameter" is used as a generic term, which stands for any kind of representation of the signal, including bits or a bitstream.

Figure 1:
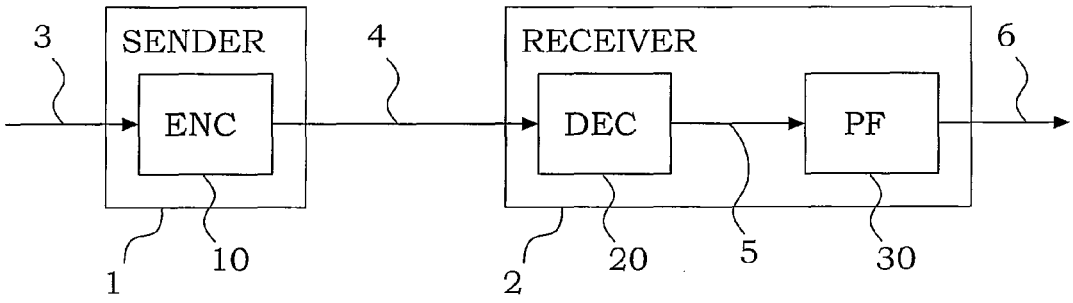
FIG. 1 is an illustration of a basic structure of an audio or speech codec with a postfilter.

In order to understand the advantages achieved by the present invention, the detailed description will begin with a short review of postfiltering in general. FIG. 1 illustrates a basic structure of an audio or speech codec with a postfilter. A sender unit 1 comprises an encoder 10 that encodes incoming audio or speech signal 3 into a stream of parameters 4. The parameters 4 are typically encoded and transferred to a receiver unit 2. The receiver unit 2 comprises a decoder 20, which receives the parameters 4 representing the original audio or speech signal 3, and decodes these parameters 4 into a decoded audio or speech signal 5. The decoded audio or speech signal 5 is intended to be as similar to the original audio or speech signal 3 as possible. However, the decoded audio or speech signal 5 always comprises coding noise to some extent. The receiver unit 2 further comprises a postfilter 30, which receives the decoded audio or speech signal 5 from the decoder 20, performs a postfiltering procedure and outputs a postfiltered decoded audio or speech signal 6.

The basic idea of postfilters is to shape the spectral shape of the coding noise such that it becomes less audible, which essentially exploits the properties of human sound perception. In general this is done such that the noise is moved to perceptually less sensitive frequency regions where the speech signal has relatively high power (spectral peaks) while it is removed from regions where the speech signal has low power (spectral valleys). There are two fundamental postfilter approaches, short-term and long-term postfilters, also referred to as formant and, respectively, pitch or fine-structure filters. In order to get good performance usually adaptive postfilters are used.

As mentioned above, pitch or fine-structure postfilters are useful within the present invention. The superposition of the decoded speech signal with time-shifted versions of it, results in an attenuation of uncorrelated coding noise in relation to the desired speech signal, especially in between the speech harmonics. The described effect can be obtained both with non-recursive and recursive filter structures. One such general form described in [4] is given by:

$$H(z) = \frac{1 + \alpha z^{-T}}{1 - \beta z^{-T}},$$

where T corresponds to the pitch period of the speech.

In practice non-recursive filter structures are preferred. One more recent non-recursive pitch postfilter method is described in the published US patent application 2005/0165603, which is applied in the 3GPP (3rd Generation Partnership Project) AMR-WB+(Extended Adaptive Multi-Rate-Wideband codec) [3GPP TS 26.290] and 3GPP2 VMR-WB (Variable Rate Multi-Mode Wideband codec) [3GPP2 C.S0052-A: "Source-Controlled Variable-Rate Multimode Wideband Speech Codec (VMR-WB), Service Options 62 and 63 for Spread Spectrum Systems"] audio and speech coding standards. Here, the basic idea is firstly to calculate a coding noise estimate r(n) by means of the following relation:

$$r(n)=y(n)-y_p(n),$$

where y(n) is the decoded audio or speech signal and $y_p(n)$ is a prediction signal calculated as:

$$y_p(n)=0.5\cdot(y(n-T)+y(n+T)). \quad (1)$$

Secondly, a low-pass (or band-pass) filtered version of the noise estimate, weighted with some factor $\alpha$ is subtracted from the speech signal, resulting in the enhanced audio or speech signal:

$$y_{enh}(n)=y(n)-\alpha\cdot LP\{r(n)\}. \quad (2)$$

A suitable interpretation of the low-pass filtered noise signal, if inverted in sign, is to look at it as enhancement signal compensating for a low-frequency part of the coding noise. The factor $\alpha$ is adapted in response to the correlation of the prediction signal and the decoded speech signal, the energy of the prediction signal and some time average of the energy of difference of the speech signal and the prediction signal.

As mentioned, one problem with pitch postfilters of prior art which evaluate the above defined expression $y_p(n)=0.5\cdot(y(n-T)+y(n+T))$ is that they require one future pitch period of the decoded speech signal y(n+T), in turn adding algorithmic delay. AMR-WB+ and VMR-WB solve this problem by extending the decoded audio or speech signal into the future, based on the available decoded audio or speech signal and assuming that the audio or speech signal will periodically extend with the pitch period T. Under the assumption that the decoded audio or speech signal is available up to, exclusively, the time index n+, the future pitch period is calculated according to the following expression:

$$\hat{y}(n+T)) = \begin{cases} y(n+T) & n+T < n^+ \\ y(n) & n+T \geq n^+ \end{cases}.$$

As this extension is only an approximation, there is some compromise in quality compared to what could be obtained if the true future decoded speech signal was used. It is to be noted that [6] does not provide any desirable solution to this problem either. It rather specifies that postfiltering with future synthesized speech data within the present frame is only done provided that subframes are available which follow the subframe to be enhanced. In particular, this document only envisions the availability of the speech frames up to the present speech frame but no future frames.

Another related postfilter method which though has lower relevancy in the context of the invention is specified in [7]. This patent describes a postfilter method for a variable-rate speech codec in which the strength of the postfilter is controlled in response to the average bit rate.

Traditional post filters (e.g. Formant/Pitch) do not introduce any delay in order to keep the codec delay at a minimum. This is since usually the coding delay budget is spent more effectively in the encoder for e.g. look ahead. This fact causes the following problems reducing the enhancement capability of the postfilter.

It is to be noted that the time extension is a problem especially in cases where the pitch period of the speech signal is non-stationary. This is particularly the case in voiced speech onsets. More generally, it can be stated that the performance of conventional postfilters in speech transients is not optimal since their parameters are comparably unreliable.

An important part of the basic idea of the invention is therefore to enhance postfilter performance by means of utilizing information from future frames. In order to do so, inherent time delays in the receiving and decoding operations are utilized. The present invention is based on a situation, where a decoded signal of a frame becomes available in connection to or later than parameters of a subsequent frame becomes available. In other words, the collective constituted by the receiver input and the decoder is arranged to provide a decoded signal y(n) of a first frame, n, essentially simultaneously as a parameter x(n+1) of a frame, n+1, successive to the first frame, n. The decoded speech frame y(n) is fed into the postfilter producing an enhanced output speech frame $y_{out}(n)$. According to the invention the postfilter operation is enhanced by means of providing the postfilter access to parameters x(n+1) of at least one later frame, n+1. Since the signal delay is inherent in the receiving and decoding operations, no additional signal delay is caused.

Figure 2:
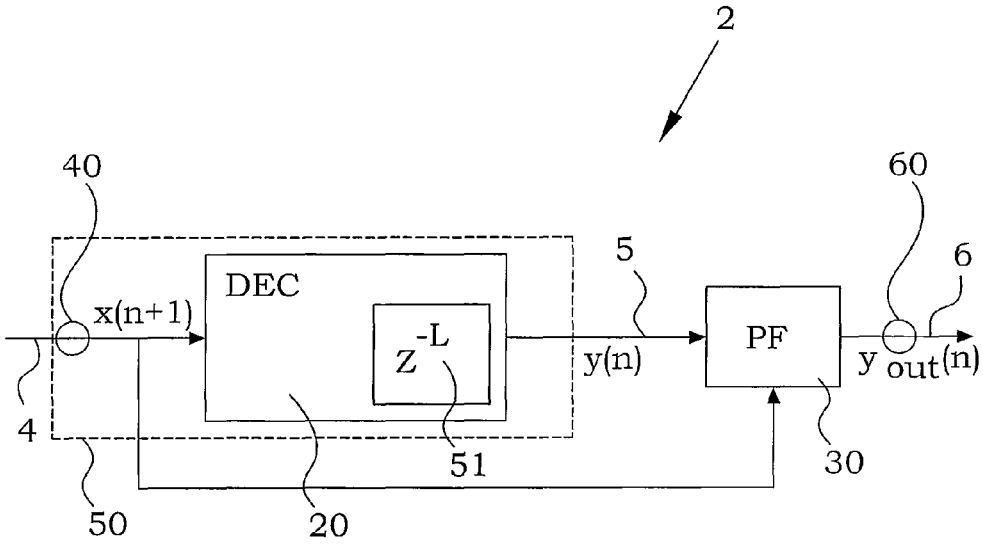
FIG. 2 illustrates a block scheme of an embodiment of a decoder arrangement according to the present invention.

One embodiment comprises a decoder operating according to an algorithm causing a delay of the output by at least the frame length L. The coded speech frame of index n+1 is then available in the receiver when the decoder outputs the decoded speech frame y(n), and can be used for postfiltering purposes. Such delays are available in different decoder arrangements. FIG. 2 illustrates a block scheme of such an embodiment of a decoder arrangement according to the present invention. A receiver unit 2 comprises a receiver input 40, arranged to receive the parameters 4 representing frame-based coded signals x(n+1), typically coded speech or audio signals. A decoder 20 is connected to the receiver input 40, arranged to provide frames y(n) of decoded audio signals 5 based on said parameters 4. The decoder 20 is arranged to present a time difference between the occasion when parameters 4 of a first frame is available at the receiver input 40 and the occasion when a decoded audio signal of the first frame is available at the output of the decoder 20, which time difference corresponds to at least one frame. In the present embodiment, the decoding operation causes a delay 51 of the signal by one frame. The collective 50 of the decoder 20 and the receiver input 40 thus present a decoded signal y(n) at the same time as parameters of a successive frame x(n+1).

A postfilter 30 is connected to an output of the decoder 20 and to the receiver input 40. The postfilter 30 is arranged to provide an output signal 6 based on the frames 5 of decoded audio signals in response to the parameters x(n+1) of a subsequent frame. Knowledge of future signal frames can thereby be utilized in the postfiltering process, however, without adding any additional decoding delay. A receiver output 60 is connected to the postfilter 30 for outputting the output signal 6.

One essential element of a VoIP system is the jitter buffer in the receiving terminal. Its purpose is to convert the asynchronous stream of received coded speech frames contained in packets into a synchronous stream which subsequently is decoded by a speech decoder. The jitter buffer can therefore operate as a parameter buffer according to the ideas presented above. In other words, an embodiment of the invention can advantageously be applied in a VoIP application, where the jitter buffer in the receiving terminal readily provides access to future frames, provided that the buffer is not empty.

Figure 3:
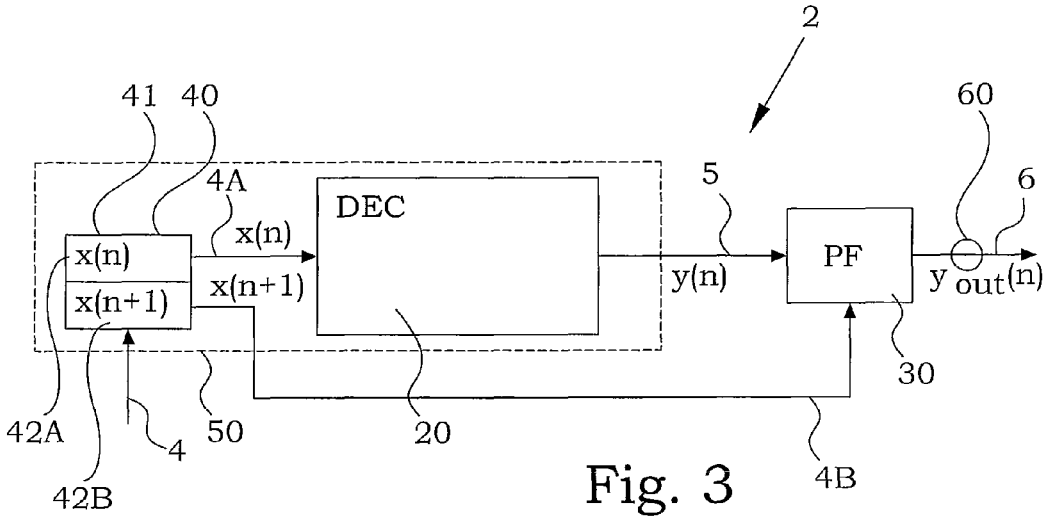
FIG. 3 illustrates a block scheme of another embodiment of a decoder arrangement according to the present invention.

Another embodiment of the present invention therefore comprises a receiver input that in turn comprises a parameter buffer, which stores the received coded speech frames, at least two frames. The decoder decodes the buffered frame n yielding the decoded speech frame y(n). At the same time, the coded speech frame of index n+1 is available in the parameter buffer, and can be used for postfiltering purposes. FIG. 3 illustrates a block scheme of such an embodiment of a decoder arrangement according to the present invention. A receiver unit 2 comprises a receiver input 40, arranged to receive the parameters 4 representing frame-based coded signals. The receiver input 40 comprises a jitter buffer 41, with storage positions 42A, 42B for parameters of at least two frames.

A decoder 20 is connected to the first position 42A of the jitter buffer 41 and is thereby provided with parameters 4A of a first frame x(n). The decoder 20 is arranged to provide frames y(n) of decoded audio signals 5 based on the parameters 4A. The receiver input 40 presents due to the jitter buffer 41 a time difference between the occasion when parameters 4B of a certain frame is available at the receiver input 40 and the occasion when a decoded audio signal 5 of the same frame is available at the output of the decoder 20, which time difference corresponds to at least one frame. In the present embodiment, the jitter operation causes the delay of the signal by at least one frame. The collective 50 of the decoder 20 and the receiver input 40 thus present a decoded signal y(n) at the same time as parameters of a successive frame x(n+1). The postfilter 30 is then arranged in the same manner as in FIG. 2.

Figure 4:
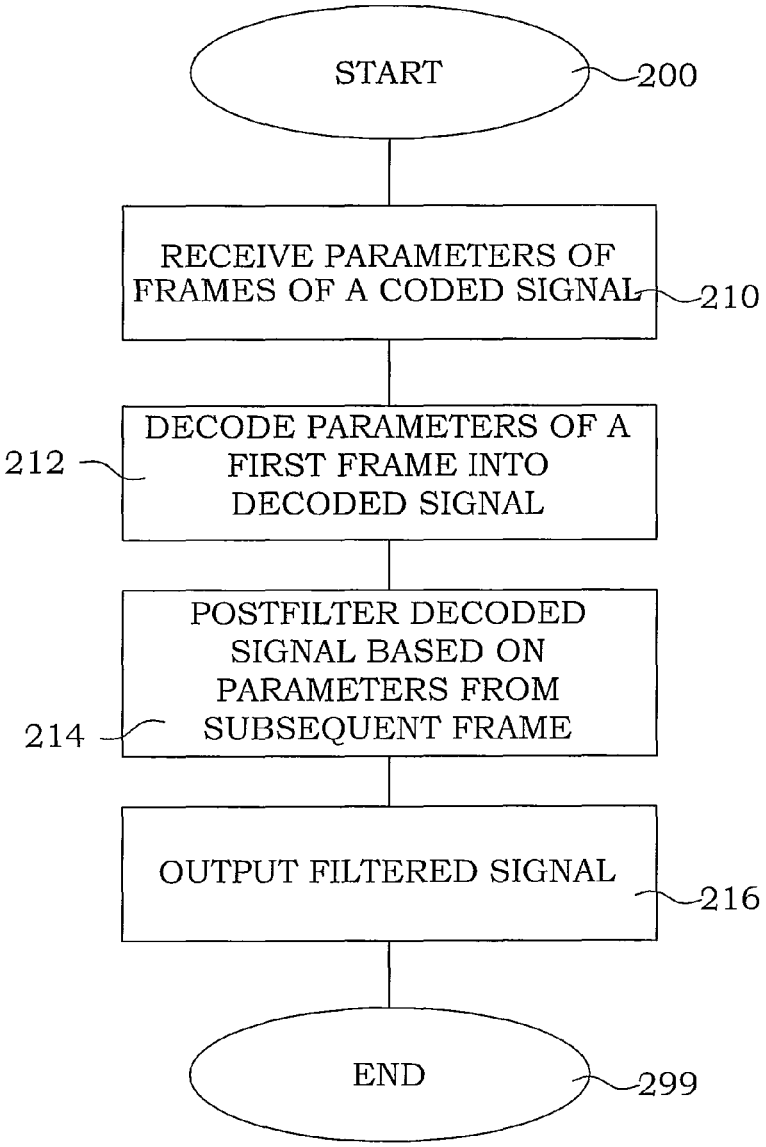
FIG. 4 is a block scheme of a general scalable audio or speech codec.

FIG. 4 illustrates a flow diagram of steps of an embodiment of a method according to the present invention. The decoding method begins in step 200. In step 210 parameters of frame-based coded signals are received. The parameters are in step 212 decoded into frames of decoded audio signals. At least one of the steps 210 and 212 causes a time difference between the occasion when parameters of a first frame are available after reception and the occasion when a decoded audio signal of the first frame is available after decoding. The time difference corresponds to at least one frame. The frames of decoded audio signals are postfiltered into an output signal in step 214 in response to the parameters of a respective subsequent frame. In step 216, the output signal is outputted. The procedure ends in step 299.

Figure 5:
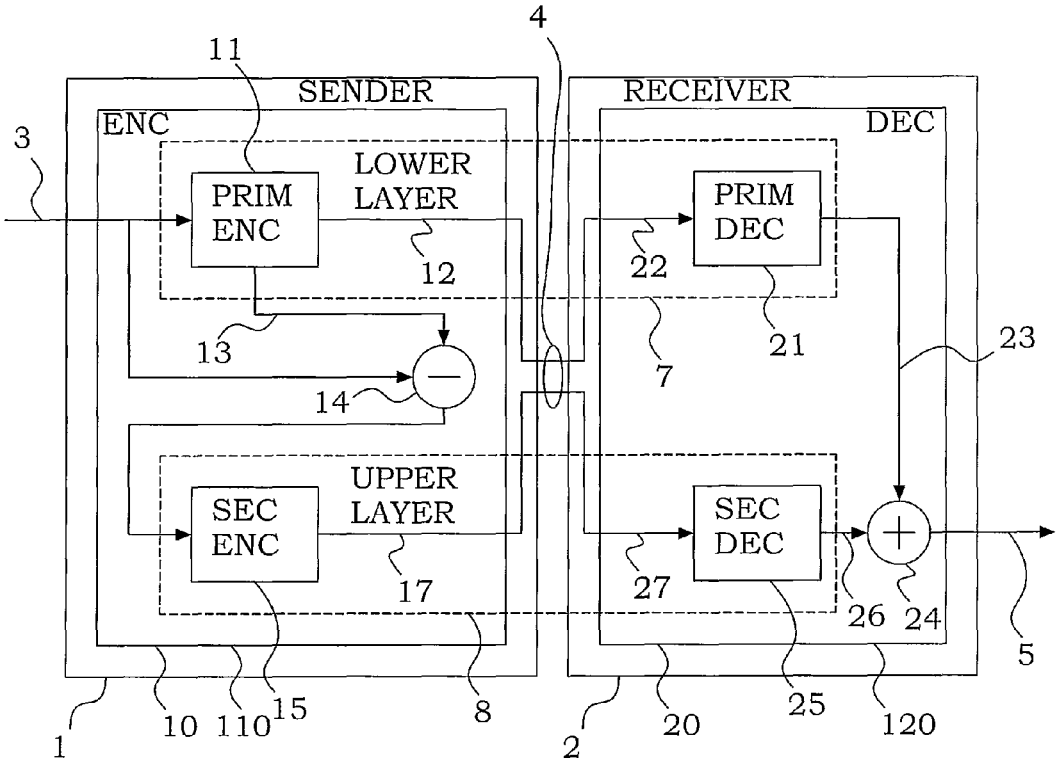
FIG. 5 is a block scheme of another scalable audio codec where higher layers support for the coding of non-speech audio signals.

A typical example of a codec having inherent delays is scalable or embedded codecs. A short review of scalable codecs is therefore presented here below. FIG. 5 illustrates a block scheme of a general scalable audio or speech codec system. The sender unit 1 here comprises an encoder 10, in this case a scalable encoder 110 that encodes incoming audio or speech signal 3 into a stream of parameters 4. The entire encoding takes place in two layers, a lower layer 7, in the sender comprising a primary encoder 11, and at least one upper layer 8, in the sender unit comprising a secondary encoder 15. The scalable codec device can be provided with additional layers, but a two-layer decoder system is used in the present disclosure as model system. However, the principles of the present invention can also be applied to scalable codecs with more than two layers. The primary encoder 11 receives the incoming audio or speech signal 3 and encodes it into a stream of primary parameters 12. The primary encoder does also decode the primary parameters 12 into an estimated primary signal 13, which ideally will correspond to a signal that can be obtained from the primary parameters 12 at the decoder side. The estimated primary signal 13 is compared with the original incoming audio or speech signal 3 in a comparator 14, in this case a subtraction unit. The difference signal is thus a primary coding noise signal 16 of the primary encoder 11. The primary coding noise signal 16 is provided to the secondary encoder, which encodes it into a stream of secondary parameters 17. These secondary parameters 17 can be viewed as parameters of a preferred enhancement of the signal decodable from the primary parameters 12. Together, the primary parameters 12 and the secondary parameters 17 form the general stream of parameters 4 of the incoming audio or speech signal 3.

The parameters 4 are typically encoded and transferred to a receiver unit 2. The receiver unit 2 comprises a decoder 20, in this case a scalable decoder 120, which receives the parameters 4 representing the original audio or speech signal 3, and decodes these parameters 4 into a decoded audio or speech signal 5. The entire decoding takes also place in the two layers; the lower layer 7 and the upper layer 8. In the receiver unit, the lower layer 7 comprises a primary decoder 21. Analogously, the upper layer 8 comprises in the receiver unit a secondary decoder 25. The primary decoder 21 receives incoming primary parameters 22 of the stream of parameters 4. Ideally, these parameters are identical to the ones created in the encoder 10, however, transmission noise may have distorted the parameters in some cases. The primary decoder 21 decodes the incoming primary parameters 22 into a decoded primary audio or speech signal 23. The secondary decoder 25 analogously receives incoming secondary parameters 27 of the stream of parameters 4. Ideally, these parameters are identical to the ones created in the encoder 10, however, also here transmission noise may have distorted the parameters in some cases. The secondary decoder 21 decodes the incoming secondary parameters 22 into a decoded enhancement audio or speech signal 26. This decoded enhancement audio or speech signal 26 is intended to correspond as accurately as possible to the coding noise of the primary encoder 11, and thereby also similar to the coding noise resulting from the primary decoder 21. The decoded primary audio or speech signal 23 and the decoded enhancement audio or speech signal 26 are added in an adder 24, giving the final output signal 5.

If only the primary parameters 22 are received in the receiving unit 2, the receiving unit only supports primary decoding or by any reason secondary decoding is decided not to be performed, the resulting decoded enhancement audio or speech signal 26 will be equal to zero, and the output signal 5 will become identical to the decoded primary audio or speech signal 23. This illustrates the flexibility of the concept of scalable codec systems. Any postfiltering is according to prior art typically performed on the output signal 5.

The most used scalable speech compression algorithm today is the 64 kbps A/U-law logarithmic PCM codec according to ITU-T Recommendation G.711, "Pulse code modulation (PCM) of voice frequencies on a 64 kbps channel", November 1988. The 8 kHz sampled G.711 codec converts 12 bit or 13 bit linear PCM (Pulse-Code Modulation) samples to 8 bit logarithmic samples. The ordered bit representation of the logarithmic samples allows for stealing the Least Significant Bits (LSBs) in a G.711 bit stream, making the G.711 coder practically SNR-scalable (Signal-to-Noise Ratio) between 48, 56 and 64 kbps. This scalability property of the G.711 codec is used in the Circuit Switched Communication Networks for in-band control signaling purposes. A recent example of use of this G.711 scaling property is the 3GPP-TFO protocol (TFO=tandem-free operation according to 3GPP TS28.062) that enables Wideband Speech setup and transport over legacy 64 kbps PCM links. Eight kbps of the original 64 kbps G.711 stream is used initially to allow for a call setup of the wideband speech service without affecting the narrowband service quality considerably. After call setup the wideband speech will use 16 kbps of the 64 kbps G.711 stream. Other older speech coding standards supporting open-loop scalability are ITU-T Recommendation G.727, "5-, 4-, 3- and 2-bit/sample embedded adaptive differential pulse code modulation (ADPCM)", December 1990 and to some extent G.722 (sub-band ADPCM).

A more recent advance in scalable speech coding technology is the MPEG-4 (Moving Picture Experts Group) standard (ISO/IEC-14496) that provides scalability extensions for MPEG4-CELP. The MPE base layer may be enhanced by transmission of additional filter parameter information or additional innovation parameter information. The International Telecommunications Union-Standardization Sector, ITU-T has recently ended the standardization of a new scalable codec according to ITU-T Recommendation G.729.1, "G.729 based Embedded Variable bit-rate coder: An 8-32 kbit/s scalable wideband coder bitstream interoperable with G.729", May 2006, nicknamed as G.729.EV. The bit rate range of this scalable speech codec is from 8 kbps to 32 kbps. The codec provides scalability from 8-32 kbps. The major use case for this codec is to allow efficient sharing of a limited bandwidth resource in home or office gateways, e.g. a shared xDSL 64/128 kbps uplink (DSL=Digital Subscriber Line, xDSL=generic term for various specific DSL methods) between several VoIP calls (Voice over Internet Protocol).

Figure 6:
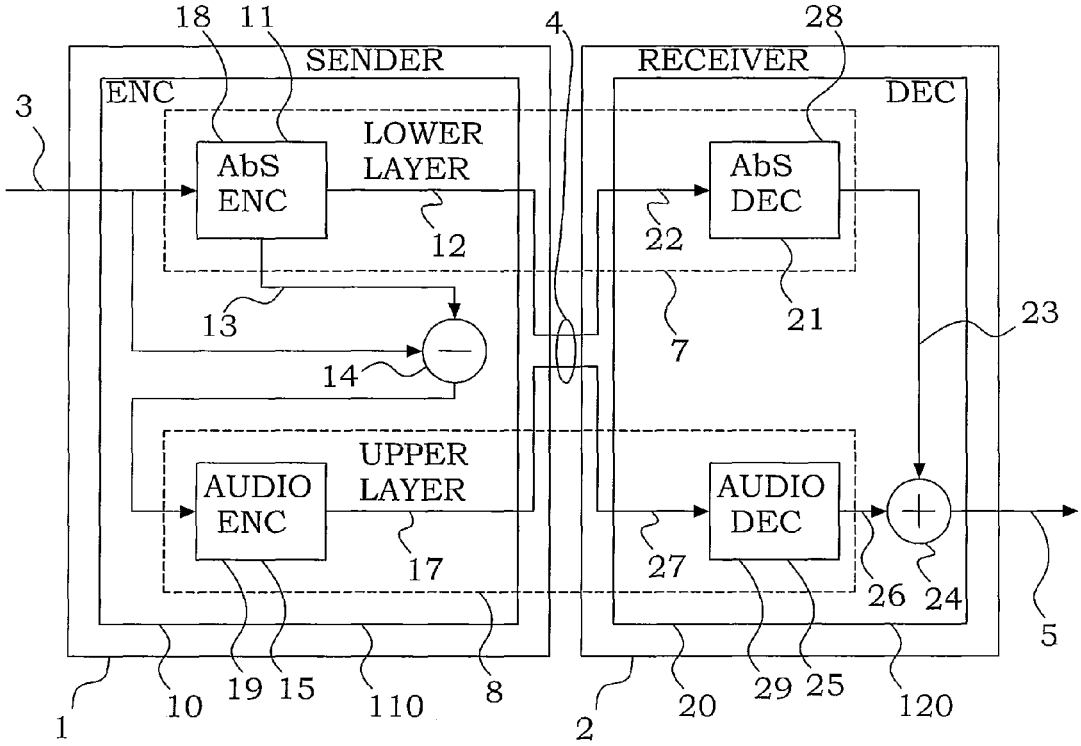
FIG. 6 illustrates a flow diagram of steps of an embodiment of a method according to the present invention.

One recent trend in scalable speech coding is to provide higher layers with support for the coding of non-speech audio signals such as music. One such approach is illustrated in FIG. 6. In such codecs the lower layer 7 employs mere conventional speech coding, e.g. according to the analysis-by-synthesis (AbS) paradigm of which CELP (Code-Excited Linear Prediction) is a prominent example. In the present embodiment, the primary encoder 11 is thus a CELP encoder 18 and the primary decoder 21 is a CELP decoder 28.

As such coding is very suitable for speech only but not that much for non-speech audio signals such as music, the upper layer 8 instead works according to a coding paradigm which is used in audio codecs. Therefore, in the present embodiment, the secondary encoder is an audio encoder 19 and the secondary decoder is an audio decoder 29. In the present embodiment, typically the upper layer 8 encoding works on the coding error of the lower-layer coding.

Figure 7:
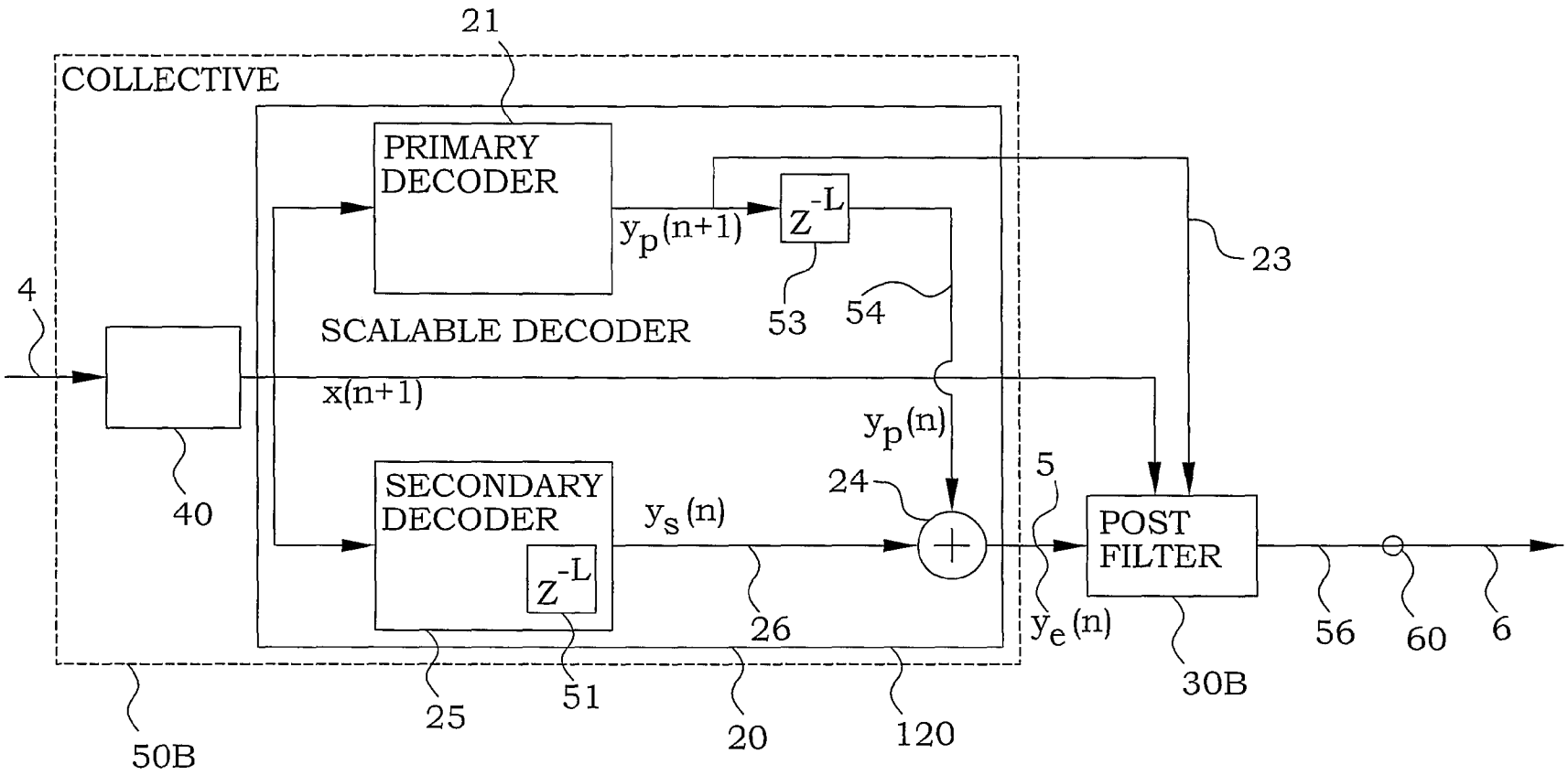
FIG. 7 illustrates a block scheme of an embodiment of a scalable decoder device according to the present invention.

One particular embodiment of the invention, illustrated in FIG. 7, is in an application in a scalable speech/audio decoder 120 in which a lower layer performs a primary decoding in a primary decoder 21 into a primary decoded signal $y_p$, while a higher layer performs a secondary decoding into a secondary enhancement signal $y_s$ in a secondary decoder 25. The secondary enhancement signal $y_s$ improves the primary decoded signal $y_p$ into an enhanced decoded signal $y_e$. It is in the present embodiment assumed that the decoder 20 operates on speech frames of e.g. 20 ms length and that the primary decoder 21 has a lower delay than the secondary decoder 25 of at least one frame. In other words, an inherent delay 51 is present within the secondary decoder 25.

In some special codec systems, the secondary codec may operate with a different frame length than the primary codec. For instance, the secondary codec may have half the frame length compared to the primary codec and hence it decodes two secondary frames while the primary decoder decodes one frame. Dependent on design, the inherent delay of the secondary decoder is either a frame length of the primary decoder or a frame length of the secondary decoder.

Specifically and as visualized in FIG. 7 it is assumed that the primary decoder 21 can decode the n+1-th speech frame x(n+1) to the output frame $y_p(n+1)$ of primary decoded signal 23 without any particular delay, i.e., based on the corresponding received coded speech frame data x(n+1) with frame index n+1. In contrast, the secondary decoder 25 requires even the next coded frame data. Hence, with the available frame x(n+1) with index n+1, the secondary decoder 25 outputs the decoded frame $y_s(n)$ of decoded secondary enhancement signal 26. In order to properly combine the decoded secondary enhancement signal 26 with the primary decoded signal 23, the latter has to be delayed by one frame. This is performed in a delay filter 53, and gives a delayed decoded primary signal 54.

This fact makes it possible to apply the invention without any penalty of increasing the delay in the decoder even further, which would be undesirable. If the received bitstream contains enhancement layer information, the frame $y_s(n)$ of the decoded secondary enhancement signal 26 can be generated. This signal 26 is combined with the frame $y_p(n)$ of the delayed primary decoded signal, together forming a frame $y_e(n)$ of the enhanced decoded signal. This frame $y_e(n)$ becomes available when the frame x(n+1) of parameters becomes available from the collective 50B. The frame $y_e(n)$ can subsequently be fed through a non-causal secondary postfilter 30B, which can take advantage from the invention, as described further above. The operation of the postfilter 30B can according to these ideas be improved by utilizing the coded parameters of frame n+1. Moreover, this postfilter 30B can take further advantage from utilizing the next frame $y_p(n+1)$ of the primary decoded signal 23, which constitutes an approximation of the still non-available future frame $y_e(n+1)$. Thus, in the present embodiment, the postfilter 30B can enhance the signal not only based on parameters of a future frame but also from a fairly good approximation of the actual signal of the future frame. The secondary postfilter 30B thereby provides a postfiltered enhanced signal 56 as output signal 6 from the decoder arrangement.

Figure 8:
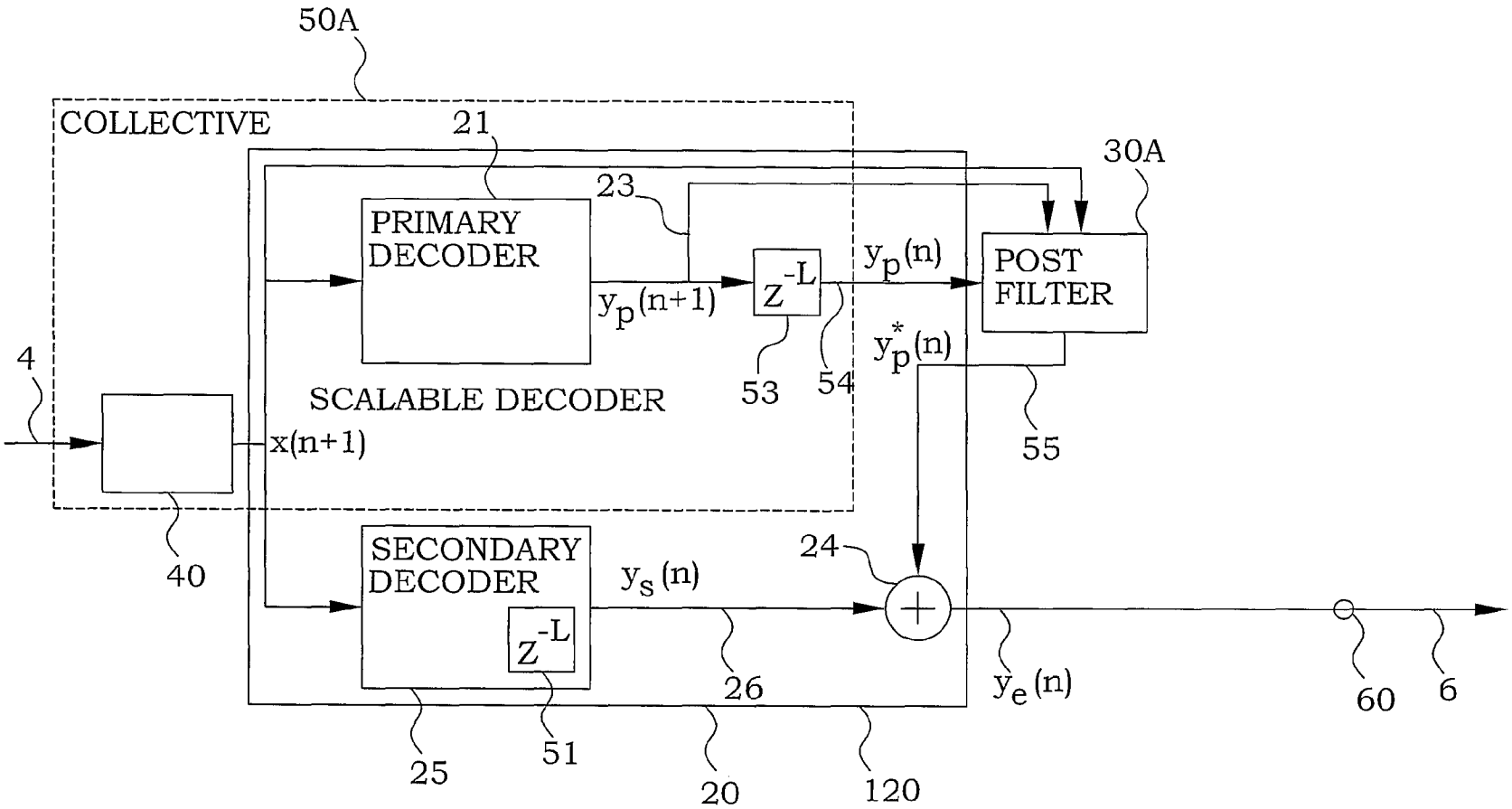
FIG. 8 illustrates a block scheme of another embodiment of a scalable decoder device according to the present invention.

FIG. 8 illustrates a block scheme of another embodiment of a scalable decoder device according to the present invention. In this embodiment, a primary postfilter 30A is provided, connected to the output from the delay filter 53, i.e. it operates on the delayed decoded primary signal 54. The collective 50A comprises in this embodiment the receiver input 40, the primary decoder 21 and the delay filter 53. The primary postfilter 30A is according to the present invention operating having access to parameters of a later frame. In this embodiment, the decoded primary signal 23 of the successive frame is also available, and can advantageously also be used in the primary postfilter 30A. In other words, the speech frame $y_p(n)$ of the delayed decoded primary signal 54 can be enhanced by a non-causal primary postfilter 30A, which takes advantage from its access to the speech frame $y_p(n+1)$ of the decoded primary signal 23 and to parameters 4 of frame n+1.

The output signal 55 from the postfilter 30A, i.e. $y_p^*(n)$, is used to be combined with the secondary enhancement signal 26 for producing the final output signal. However, in some situations, the enhancements provided by the secondary enhancement signal 26 may in some cases be similar to what can be obtained by the primary postfilter 30A, and the result may be an overcompensation of coding noise. The postfilter 30A may in such a case advantageously be arranged for determining whether the parameters for the secondary decoding are available at the receiver input 40. If secondary parameters are available, the operation of the postfilter may be turned off, thus giving the original decoded primary signal as output from the primary postfilter 30A, or at least change the postfiltering principles in order not to interfere with the operation of the secondary enhancement signal.

Figure 9:
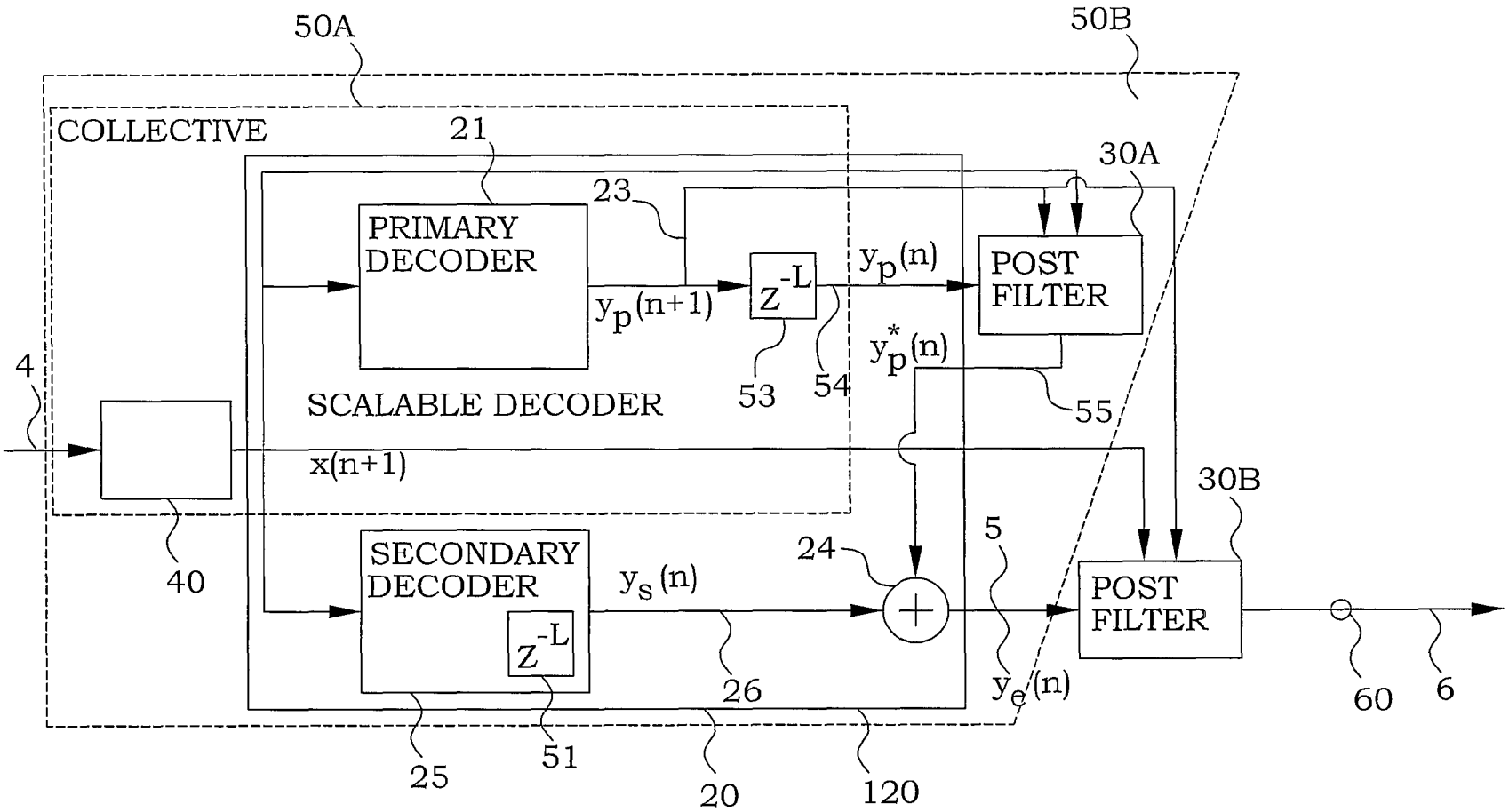
FIG. 9 illustrates a block scheme of yet another embodiment of a scalable decoder device according to the present invention.

FIG. 9 illustrates a block scheme of yet another embodiment of a scalable decoder device according to the present invention. In this embodiment, the secondary decoder 25 is again followed by a secondary postfilter 30B, as in FIG. 7, however, the primary postfilter 30A is also provided. In such embodiment, also an output signal that is provided with enhancement from the secondary decoder 25 can be further enhanced by use of a secondary postfilter 30B. Also in this case, the secondary postfilter 30B can base its operation on parameters a successive frame. While this postfilter 30B has no access to a future frame $y_e(n+1)$ of the enhanced decoder output 5, its operation can instead be based on a future frame $y_p(n+1)$ of the primary decoded signal. A primary collective 50A comprises the receiver input 40, the primary decoder 21 and the delay filter 53, while a secondary collective 50B comprises the receiver input 40, the entire scalable decoder 120 and the primary postfilter 30A.

Figure 10:
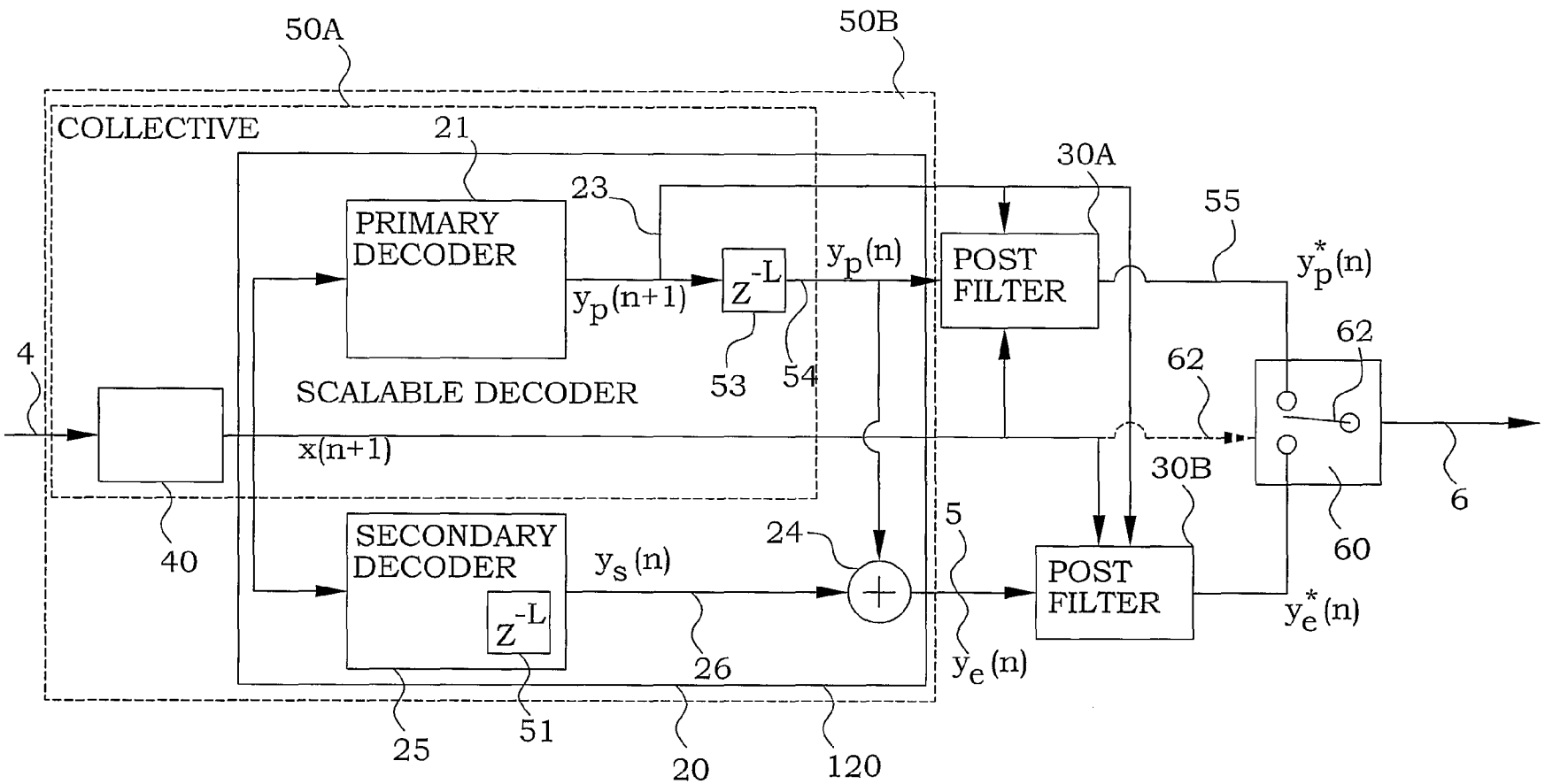
FIG. 10 illustrates a block scheme of another embodiment of a scalable decoder device according to the present invention.

FIG. 10 illustrates a block scheme of yet a further embodiment of a scalable decoder device according to the present invention. Here, the un-postfiltered delayed decoded primary signal 54 is provided to the adder 24 to be combined with the secondary enhancement signal 26. This avoids mixing the coding noise corrections of the primary postfilter 30A and the enhancement from the secondary decoder 25. Instead, the output 60 is arranged as a selector 61, arranged to output either the postfiltered decoded primary signal 55 or the postfiltered enhanced signal 56 as the output signal from the decoder arrangement. The selector 61 is preferably operated in response to the incoming signals, as indicated by the broken arrow 62. More of these possibilities are discussed further below.

A further part aspect of the present invention is as discussed here above to apply the non-causal enhancement of the postfilters depending on the characteristics of the speech or audio signal. In particular, such an application is beneficial during sound transients. Such a sound transient is for instance the transition from one phone (phonetic element) to another, which themselves are relatively steady or stationary. Typical for such transients is that the signal is non-stationary and that the parameter estimation which is done by the speech encoder is less reliable than during steady sounds. If the postfilter is based on such less reliable parameters it is likely that its performance is poor. According to the present invention the postfilter performance during such transients can be improved by utilizing parameters and preferably also synthesized speech of a future frame. The improvement is achieved since the sound during the future frame may have become steadier which allows for more reliable parameter estimation.

This embodiment relies on a detection of transients in which the specific non-causal postfilter operation is enabled. Such detection can be made with a sound classifier, which in a simple case may be a voice activity detector (VAD), or, more general, a sound detector which, apart from the basic speech/non-speech discrimination, can for instance distinguish between different kinds of speech like voiced, unvoiced, onset. Such detection can also be based on an evaluation of the time evolution of certain signal parameters such as energy or LPC parameters and identify such parts of the speech or audio signal as transient where these parameters change rapidly. The transient detector may be realized in encoder or decoder, which in the former case requires transmitting detection information to the receiver. The changes in audio characteristics can be quantified in to a significance degree and measured, and be used for controlling the operation of a postfilter. In particular, the postfilters according to the present invention may be arranged to adapt the degree in which the pitch parameter used in the pitch postfilter is based on the pitch parameter of a subsequent frame. The adaptation is performed dependent on a measure of a significance of change in audio characteristics between a present frame and a previous frame or a subsequent frame.

One particular preferred embodiment for which the postfilter performance can be improved is an application to voiced speech onsets after periods of speech inactivity. Here, specifically, the postfilter is a pitch postfilter and parameters from the future frame used in it are the subframe pitch parameters belonging to the frame following the present frame.

According to one further preferred embodiment of the invention addressing pitch postfilter improvements, the pitch parameter is handled in a novel and more accurate way. As discussed above, state of the art pitch postfilters evaluate an expression based on equations (1) and (2), where a past and a future segment of synthesized speech is combined with a present speech segment, where a segment may be a unit like a subframe or a pitch cycle. These past and future segments lag respectively lead the present segment with the pitch parameter value T. The use of T as lag parameter for the past speech segment is conceptually correct since it is in line with the adaptive codebook search paradigm of typical analysis-by-synthesis speech codecs which calculate T as the lag value which maximizes the correlation of the lagged segment with the present speech segment.

Using T as the lead parameter for the future segment is however generally not precise as it assumes that the pitch lag parameter remains constant even for the future segment. This is especially problematic in transients where the pitch may change strongly. Reference [6] provides a solution to this problem by specifying an additional lag and lead determiner based on correlation calculations between the segments. This however is disadvantageous for complexity reasons.

Figure 11:
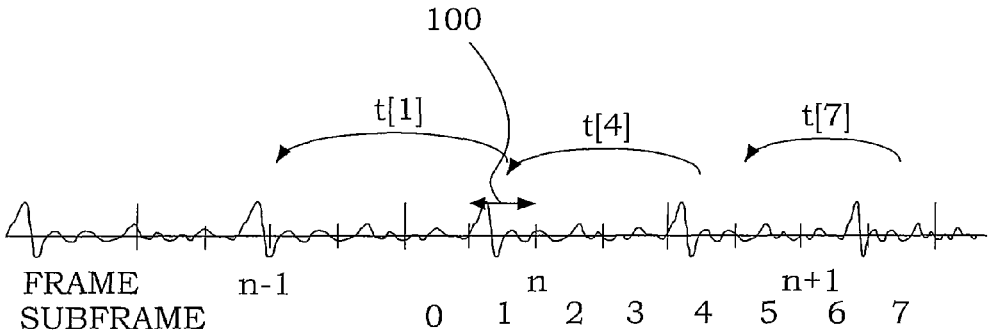
FIG. 11 illustrates an improved pitch lead parameter calculation according to the present invention.
Figure 12:
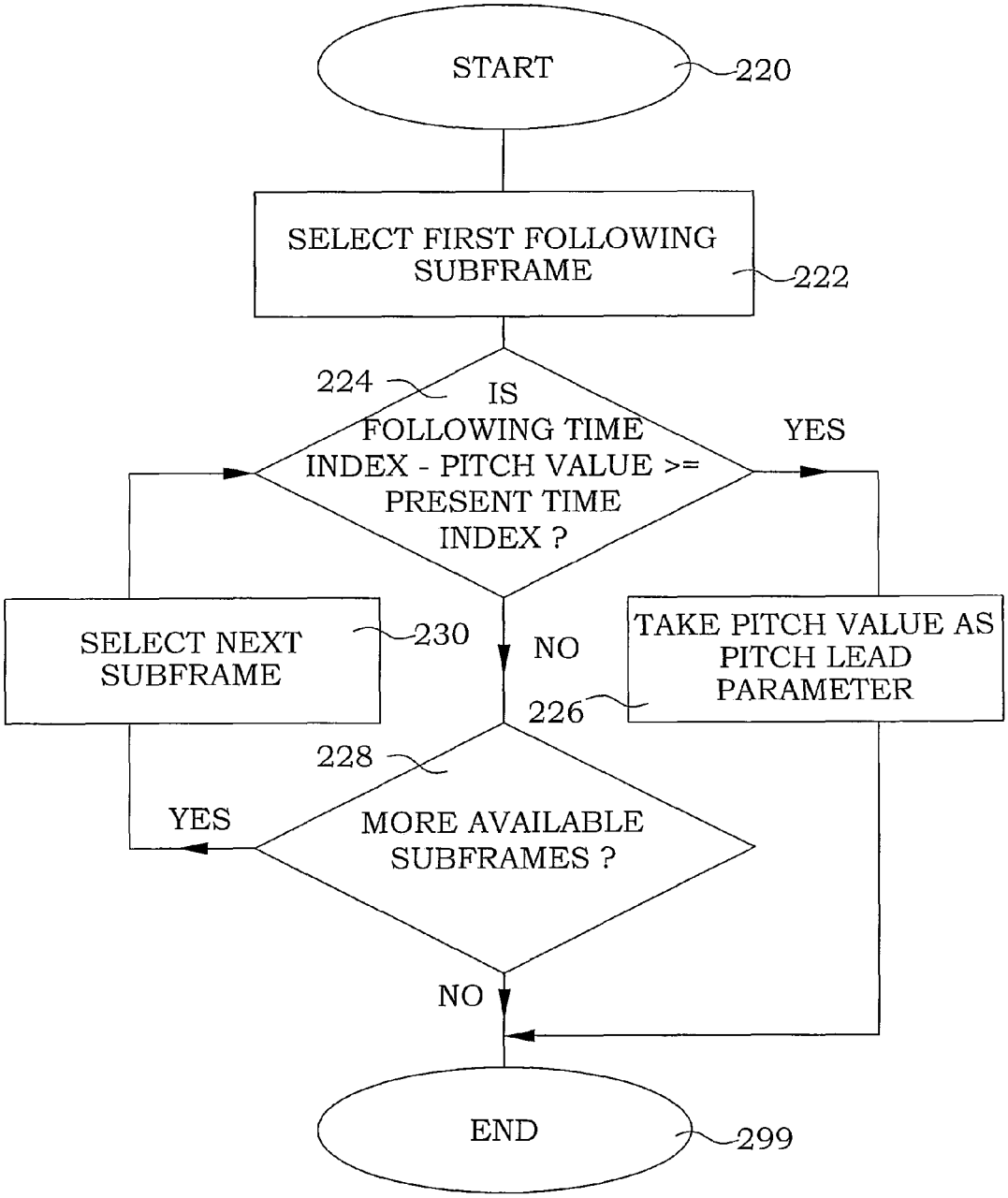
FIG. 12 illustrates an example algorithm according to which the lead parameter for a given segment can be found.

The solution to the problem according to the present invention is as follows, with references to FIG. 11. It is assumed that the pitch postfilter has access to a vector of subframe pitch parameters, for the present frame n and the at least one future frame n+1. Typically, each frame comprises 4 subframes. T[0] . . . T[3] shall denote the four subframe pitch parameters of the present frame and T[4] . . . T[7] the four subframe pitch parameters of the future frame. Given that, the lead parameter for a given segment is found by searching that subframe pitch parameter which relative to its subframe position in time lags into the present segment. According to the example in FIG. 11 for the given present segment 100 this is the case for subframe pitch value T[4]. As can also be seen in that figure, using the pitch parameter value of the present segment T[1] as lead parameter is imprecise as the pitch is changing to smaller values. A preferred example algorithm according to which the lead parameter for the given segment can be found is as follows, with reference to FIG. 12. The procedure, which will be a part of step 214 in FIG. 4, starts in step 220. A first subframe following the present segment is selected in step 222. Starting from this first subframe following the present segment, it is checked in step 224 if the subframe time index reduced by the corresponding subframe pitch value is greater or equal to the time index of the present segment. If this is the case, the subframe pitch value is taken as the pitch lead parameter for the present segment in step 226 and the algorithm stops in step 239. Otherwise the check is repeated with the next subframe. In step 228, it is checked whether there are more available subframes. If not, the procedure ends in step 239, otherwise a new subframe is selected in step 230 and the check of step 224 is repeated. In this algorithm the subframe time index may e.g. be the start or mid time index of the subframe. It can be noted that this algorithm could with some gain also be used if a lead determiner as described in reference [6] is used as this can help to save complexity by limiting the range over which correlation calculations have to be carried out.

The embodiments described above are to be understood as a few illustrative examples of the present invention. It will be understood by those skilled in the art that various modifications, combinations and changes may be made to the embodiments without departing from the scope of the present invention. In particular, different part solutions in the different embodiments can be combined in other configurations, where technically possible. The scope of the present invention is, however, defined by the appended claims.

REFERENCES

[1] P. Kroon, B. Atal, "Quantization procedures for 4.8 kbps CELP coders", in Proc IEEE ICASSP, pp. 1650-1654, 1987.

[2] V. Ramamoorthy, N. S. Jayant, "Enhancement of ADPCM speech by adaptive postfiltering", AT&T Bell Labs Tech. J., pp. 1465-1475, 1984.

[3] V. Ramamoorthy, N. S. Jayant, R. Cox, M. Sondhi, "Enhancement of ADPCM speech coding with backward-adaptive algorithms for postfiltering and noise feed-back", IEEE J. on Selected Areas in Communications, vol. SAC-6, pp. 364-382, 1988.

[4] J. H. Chen, A. Gersho, "Adaptive postfiltering for quality enhancements of coded speech", IEEE Trans. Speech Audio Process., vol. 3, no. 1, 1995.

[5] B. Besette et al., "Method and device for frequency-selective pitch enhancement of synthesized speech", Patent application US20050165603A1.

[6] L. Bialik et al., "A pitch post-filter", EP-0807307B1.

[7] Pasi Ojala et al., "A decoding method and system comprising an adaptive postfilter", EP 1 050 040 B1.

The invention claimed is:

1. A decoder arrangement, comprising:

a receiver input for parameters of frame-based coded signals;

a decoder connected to said receiver input, arranged to provide frames of decoded audio signals based on said parameters;

a postfilter connected to an output of said decoder and arranged to provide an output signal based on said frames of decoded audio signals;

wherein at least one of said receiver input and said decoder is arranged to establish a time difference between the occasion when parameters of a first frame (x(n)) is available at said receiver input and the occasion when a decoded audio signal of said first frame (y(n)) is available at said output of said decoder, which time difference corresponds to at least one frame;

the postfilter further arranged to receive said first frame of the decoded audio signals (y(n)) essentially simultaneously as the parameter of a respective subsequent frame (x(n+1));

wherein said postfilter is connected to said receiver input; and, wherein said postfilter is arranged to provide a filtering of said first frame of the decoded audio signals (y(n)) into an output signal ($y_{out}(n)$) using said parameter of the respective subsequent frame (x(n+1)).

2. The decoder arrangement according to claim 1, wherein said receiver input comprises a storage for parameters of at least two consecutive frames, wherein said decoder is provided with parameters of a first frame and said postfilter has access to parameters of a subsequent second frame.

3. The decoder arrangement according to claim 1, wherein said decoder comprises means for delaying said frames of decoded audio signals before being outputted to said postfilter.

4. The decoder arrangement according to claim 1, wherein said postfilter comprises a pitch postfilter, wherein a pitch parameter used in said pitch postfilter is based on a pitch parameter of said subsequent frame.

5. The decoder arrangement according to claim 4, wherein said pitch postfilter of said postfilter is arranged for determining, for a following subframe, a value of a time index reduced by a pitch value for said following subframe, and taking, if said determined value is larger or equal to a present time index, said pitch value for said following subframe as pitch lead parameter for said present frame.

6. The decoder arrangement according to claim 4, further comprising an audio characteristics detector, an output of which is connected to said postfilter; wherein said postfilter is arranged to adapt the degree in which said pitch parameter used in said pitch postfilter is based on said pitch parameter of said subsequent frame dependent on a measure of a significance of change in audio characteristics between a present frame and at least one of a previous frame and a subsequent frame.

7. The decoder arrangement according to claim 6, wherein said audio characteristics detector is at least one of a voice activity detector and a voicing detector, wherein said postfilter is arranged to base said pitch parameter used in said pitch postfilter on said pitch parameter of said subsequent frame in case of a detected voiced speech onset.

8. The decoder arrangement according to claim 1, wherein said postfilter is arranged to have access also to a decoded signal of said subsequent frame.

9. The decoder arrangement according to claim 1, wherein said decoder is a scalable decoder or a part of a scalable decoder, wherein a secondary decoder of said scalable decoder has a higher delay than a primary decoder of said scalable decoder.

10. A decoder arrangement comprising a scalable decoder and at least two decoder arrangements according to claim 7.

11. A decoding method, comprising the steps of:

receiving parameters of frame-based coded signals;

decoding said parameters into frames of decoded audio signals;

wherein at least one of said step of receiving and said step of decoding causes a time difference between the occasion when parameters of a first frame (x(n)) is available after reception and the occasion when a decoded audio signal of the first frame (y(n)) is available after decoding, which time difference corresponds to at least one frame;

receiving, at a postfilter, said first frame of the decoded audio signals (y(n)) essentially simultaneously as the parameter of a respective subsequent frame (x(n+1));

postfiltering said first frame of the decoded audio signals (y(n)) into an output signal ($y_{out}(n)$) using said parameter of the respective subsequent frame (x(n+1)); and, outputting said output signal.

12. The decoding method according to claim 11, further comprising the step of storing parameters of at least two consecutive frames at each instant, wherein said step of decoding is performed with parameters of a first frame and said postfiltering is performed with access to parameters of a subsequent second frame.

13. The decoding method according to claim 11, further comprising the step of delaying said frames of decoded audio signals before performing said step of postfiltering.

14. The decoding method according to claim 11, wherein said step of postfiltering comprises pitch postfiltering, wherein a pitch parameter used in said pitch postfiltering is based on a pitch parameter of said subsequent frame.

15. The decoding method according to claim 14, wherein said pitch postfiltering in said step of postfiltering comprises:

determining, for a following subframe, a value of a time index reduced by a pitch value for said following subframe; and, taking, if said determined value is larger or equal to a present time index, said pitch value for said following subframe as pitch lead parameter for said present frame.

16. The decoding method according to claim 14, further comprising the step of detecting audio characteristics of said frame-based coded signals; wherein said step of postfiltering adapts the degree in which said pitch parameter is based on said pitch parameter of said subsequent frame dependent on a measure of a significance of change in audio characteristics between a present frame and at least one of a previous frame and a subsequent frame.

17. The decoding method according to claim 16, wherein said step of detecting comprises detecting of at least one of voice activity and voicing and wherein said step of postfiltering bases said pitch parameter on said pitch parameter of said subsequent frame only in case of a detected voiced speech onset.

18. The decoding method according to claim 11, wherein said step of postfiltering is performed also in response to a decoded signal of said respective subsequent frame.

19. The decoding method according to claim 11, wherein said step of decoding comprises decoding in a scalable decoder wherein a secondary decoding involves a higher delay than a primary decoding.

20. A decoding method comprising at least two decoding methods according to claim 19.

* * * * *